US006223578B1

(12) United States Patent
Kamijo

(10) Patent No.: US 6,223,578 B1
(45) Date of Patent: May 1, 2001

(54) METHOD OF MANUFACTURING A SHEET PRESSING WHEEL

(75) Inventor: Tadashi Kamijo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/403,082

(22) PCT Filed: Feb. 5, 1999

(86) PCT No.: PCT/JP99/00497

§ 371 Date: Oct. 15, 1999

§ 102(e) Date: Oct. 15, 1999

(87) PCT Pub. No.: WO99/46068

PCT Pub. Date: Sep. 16, 1999

(30) Foreign Application Priority Data

Mar. 10, 1998 (JP) ..... 10-058648

(51) Int. Cl.[7] ..... B21D 28/02; B21D 53/28

(52) U.S. Cl. ..... 72/336; 72/334; 29/893.33; 29/893.34; 347/4

(58) Field of Search ..... 72/334, 336, 340; 29/893.33, 893.34, 891; 347/4

(56) References Cited

U.S. PATENT DOCUMENTS

| | | | | |
|---|---|---|---|---|
| 1,454,508 | * | 5/1923 | Eckert . | |
| 1,991,689 | * | 2/1935 | McClintock | 72/334 |
| 2,195,163 | * | 3/1940 | Bott . | |
| 4,349,963 | * | 9/1982 | Peterson | 72/379 |
| 4,727,636 | * | 3/1988 | Nagano | 28/893.33 |
| 5,077,961 | * | 1/1992 | Schumacher | 72/340 |
| 5,516,376 | * | 5/1996 | Tsukamoto | 72/334 |
| 5,560,726 | | 10/1996 | Kawaguchi | 400/641 |

FOREIGN PATENT DOCUMENTS

| | | | | |
|---|---|---|---|---|
| 54-97888 | | 8/1979 | (JP) . | |
| 6312866 | | 11/1994 | (JP) . | |
| 1759513 | * | 9/1992 | (SU) | 72/334 |

OTHER PUBLICATIONS

English Abstract of JP 5497888 Dated Feb. 1979.
English Abstract of JP6312866 Dated Nov. 1994.

* cited by examiner

*Primary Examiner*—Daniel C. Crane
(74) *Attorney, Agent, or Firm*—Ladas and Parry

(57) ABSTRACT

A method for manufacturing a metal part and a sheet pressing wheel, in which reduction of their manufacturing cost is intended by enabling them to be formed only by plastic work such as press-work even if they are very small; and a printer in which such wheels are incorporated as a sheet feed mechanism. In the method for manufacturing a metal part, plastic work is given to a metal plate to thereby manufacture the metal part. The method for manufacturing a metal part comprises a first forming step for performing a punching work for roughly forming at least a part of the outline shape of the metal part; a second forming step for giving a face-pressing work to at least an outline edge portion of the metal part to thereby thin the outline edge portion; and a third forming step for shaping the outline shape again by a punching work.

6 Claims, 7 Drawing Sheets

METHOD OF MANUFACTURING A SHEET PRESSING WHEEL

This application is a 371 of PCT/JP99/00497, filed Feb. 5, 1999.

FIELD OF THE INVENTION

The present invention relates to a method for manufacturing metal parts and sheet pressing wheels, and a printer in which such sheet pressing wheels are used in a sheet feeding mechanism. The present invention particularly relates to a metalworking technique suitable for forming a very fine outline shape of a metal part.

BACKGROUND OF THE INVENTION

Some sheet feed mechanisms mounted on printers use gear-shaped sheet pressing wheels (hereinafter referred to as "star wheels") in which tooth portions with comparatively sharp tips are arrayed in an outer circumferential portion of each star wheel. A plurality of such star wheels are attached rotatably around a shaft disposed perpendicularly to the sheet feed direction, and each star wheel is disposed in opposition to a paper discharge roller. The star wheels catch a sheet, which is fed in a predetermined feed course by drive rollers, by means of the comparatively sharp tips of the tooth portions in their circumferential portions while the sheet is held between the sheet discharge rollers and the star wheels, so as to prevent the sheet from slipping off to the side and control the sheet to run in a regular feed direction.

Conventionally, when such a star wheel is manufactured, a gear-like plane shape is first formed by a punching process, and tips of tooth portions are thereafter thinned by an etching process in order to form acuminated shapes in the tips of the tooth portions. This is because the curvature radius in the plane shape of the tip of each tooth portion of the star wheel has to be made extremely small as 0.04 mm, and the thickness of the tip of the tooth portion has to be also made extremely small as 0.06 mm.

If the area of the tip of the tooth portion becomes large in the star wheel, in the case where ink printed on a sheet adheres to the tip of the tooth portion, this ink is transferred to other portions of the sheet so that spotted marks large enough to be visible are left on the sheet. On the other hand, if the tip portion of the tooth portion of the star wheel is too sharp or has a burr, the tip portion may damage the surface of the sheet discharge roller, or cut into the sheet and damage it. Therefore, the shape of the tip of any tooth portion of the star wheel has a very fine shape as mentioned above, and manufacturing precision is demanded.

In the above-mentioned manufacturing method, however, process control and others take a great deal of labor in the etching process so as to increase the cost. In addition, the corners of the tip portions get pointed by the etching process, so that there is a problem that it is impossible to avoid the above-mentioned disadvantage.

In addition, in the case where the plane shape is formed by press-working as mentioned above, there is a problem that since the curvature radius of the tip of each tooth portion is so small that it is difficult to perform press-working on a thick metal sheet, it is difficult to ensure the rigidity of the star wheel. Further, since very fine shapes having a small curvature radius have to be formed, there is another problem that a load on a press die becomes so large as to shorten the life of the press die.

Further, since there is an etching process after press-working as mentioned above, it is necessary to carry very small and individually separated star wheels and set them for the etching process. Such working is extremely troublesome, and it is difficult to mechanize all the working. Therefore, there is a problem that increase of the manufacturing cost is caused and the manufacturing efficiency cannot be improved to be higher than the current one.

SUMMARY OF THE INVENTION

It is an object of the present invention to provide a method for manufacturing a metal part in which the part is formed only by plastic working such as press-working, even if it is a very small part, so as to achieve reduction of the manufacturing cost and make it possible to improve the manufacturing efficiency.

It is another object of the present invention to provide a method for manufacturing a star wheel as such a very small metal part.

It is a further object of the present invention to provide a printer in which such star wheels are incorporated as a sheet feed mechanism.

A method for manufacturing a metal part by plastic working of a metal plate according to the present invention comprises a first forming step of performing a punching operation for roughly forming at least a part of the outline shape of the metal part; a second forming step of performing a face pressing operation on at least an outline edge portion of the metal part to thereby thin the outline edge portion; and a third forming step for shaping the thinned outline edge portion again by a punching.

Moreover, in a method for manufacturing a star wheel according to the present invention, a hole for forming a bearing portion therein is punched out in a center portion of the metal part manufactured in the above-mentioned manner.

Moreover, in a printer according to the present invention, a sheet feed mechanism is mounted thereon, and such star wheels as mentioned above are incorporated in the sheet feed mechanism.

According to the present invention, at least a part of the outline shape is roughly formed in the first forming step, a face pressing work is given in the second forming step to the outline edge portion so as to thin the outline edge portion, and the thinned outline edge portion is shaped again in the third forming step. Thus, since the face pressing work is given after the outline shape is roughly formed in the first forming step, forming in the second forming step becomes easy. In addition, since the outline edge portion thinned in the second forming step is shaped again, a fine outline shape can be easily and precisely formed in the third forming step. It is therefore possible to prolong the life of press dies for the forming steps. Further, since the metal part can be formed only by punching work and pressing work, it is possible to reduce the manufacturing cost and improve the productivity.

Here, assume that the metal part which is a target of the present invention has a protrusive portion in its outline edge portion. Then, it is preferable that the first forming step and the third forming step are carried out to form a plane surface shape of the protrusive portion out of a metal plate, and the second forming step is carried out to form a sectional shape of the protrusive portion out of the metal sheet.

In this case, according to the present invention, the plane shape of the protrusive portion is roughly formed in the first forming step; the sectional shape of the protrusive portion is formed in the second forming step; and the plane shape of the protrusive portion is formed in the third forming step. It is therefore possible to form the protrusive portion easily and precisely even if the protrusive portion has a very fine outline shape.

In this case, it is also preferable that the metal part is a gear or gear-shaped part having an array of teeth as the protrusive portion. According to the present invention, it is possible to form the outline shape of an array of teeth of a gear or a gear-shaped part easily and precisely. As many of gears or gear-shaped parts have a very fine teeth shape, the present invention is extremely effective in forming such a very fine outline shape at a low price.

Further in this case, it is preferable that the metal part is a star wheel for controlling the sheet feed direction in a sheet feed mechanism. According to the present invention, it is possible to form the tip shapes of the tooth portions of the star wheel easily and precisely. Particularly in the star wheel, the tips of the tooth portions have a very fine and sharp shape, and the shape of the sharp tips of the tooth portions has to be formed precisely for the sake of ensuring the performance. It is therefore possible to provide a high-performance star wheel at a low cost.

In the above-mentioned respective steps of the present invention, it is preferable to perform the respective forming steps by progressive press-work from the point of view of productivity and cost. In that case, it is desirable to form the metal part while feeding a band-like metal plate. The forming steps are preferably performed in the condition that connection portions are left in the metal plate to be able to hold the outline shape of the metal part in position, until at least the second forming step. In that case, it is preferable to punch out the plurality of punched portions in separate timings independent of each other. This is because, the press die can be made in an insert die construction and the inserted die can be miniaturized, so that it can be expected to reduce the manufacturing cost, to improve in the maintenance efficiency, and so on.

Moreover, when the metal part is further integrated with another material by insert molding or the like after the above-mentioned respective forming steps are finished, it is preferable, in view of improvement in the manufacturing efficiency, that a process for integrating the metal part with the other material is performed while the metal part is kept in the metal plate through the connection portions, and a punching work is thereafter performed to cut the connection portions.

Star wheels manufactured thus are incorporated in a sheet feed mechanism, and the sheet feed mechanism is mounted on a printer such as an ink-jet recording apparatus or the like. Accordingly, a paper feed operation is performed appropriately in the printer.

THE BEST MODE FOR CARRYING OUT THE INVENTION

Embodiment 1.

Figure 1:
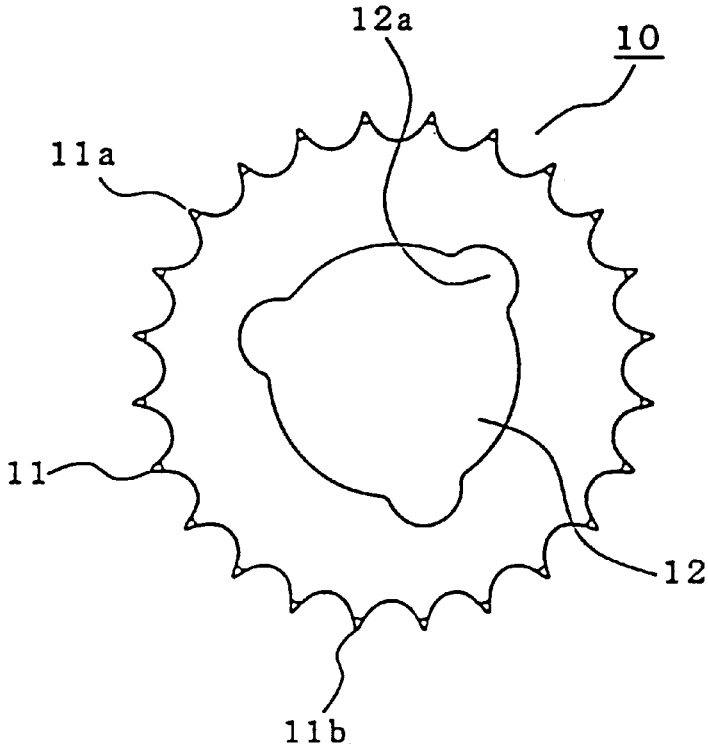
FIG. 1 is a plan view illustrating the shape of a star wheel formed by a method for manufacturing a metal part according to an embodiment 1 of the present invention.
Figure 2A:
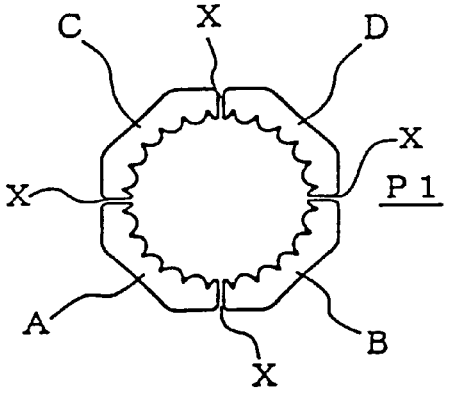
FIGS. 2(*a*) to 2(*f*) are step explanatory diagrams illustrating changes in an outline shape in accordance with respective forming steps to explain the manufacturing method of the embodiment 1 schematically.
Figure 2D:
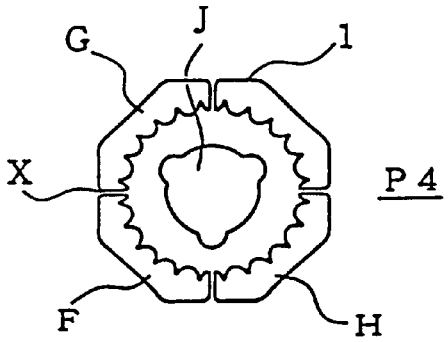
Figure 2B:
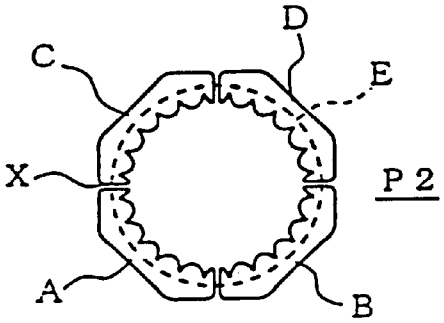
Figure 2E:
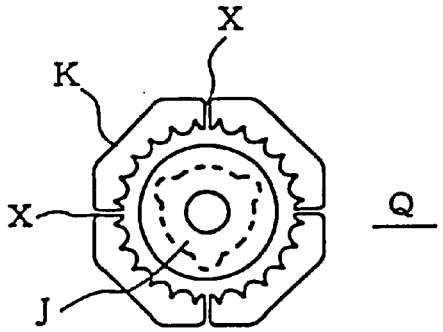
Figure 2C:
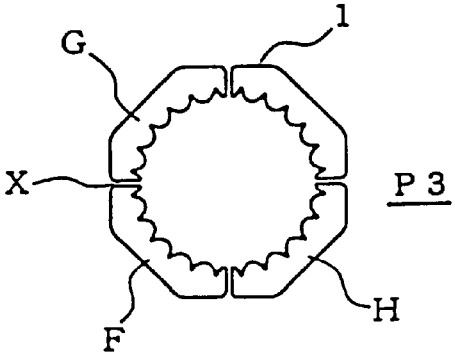
Figure 2F:
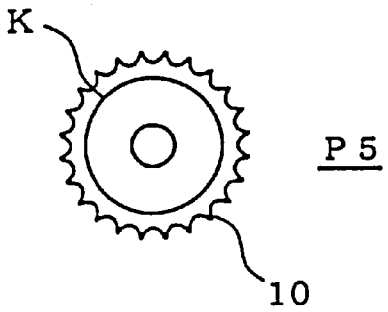

A star wheel 10 has a plane shape in which a number of tooth portions 11 are formed in an outer circumferential portion thereof as shown in FIG. 1. In addition, a central hole 12 is provided in a central portion of the star wheel, and in an open edge portion of this central hole 12 three semicircular notch portions 12*a* are formed at equal circumferential spacing. A bearing portion consisting of synthetic resin is formed integrally with the central hole 12 as will be described later (see FIG. 2(*e*)).

Figure 6:
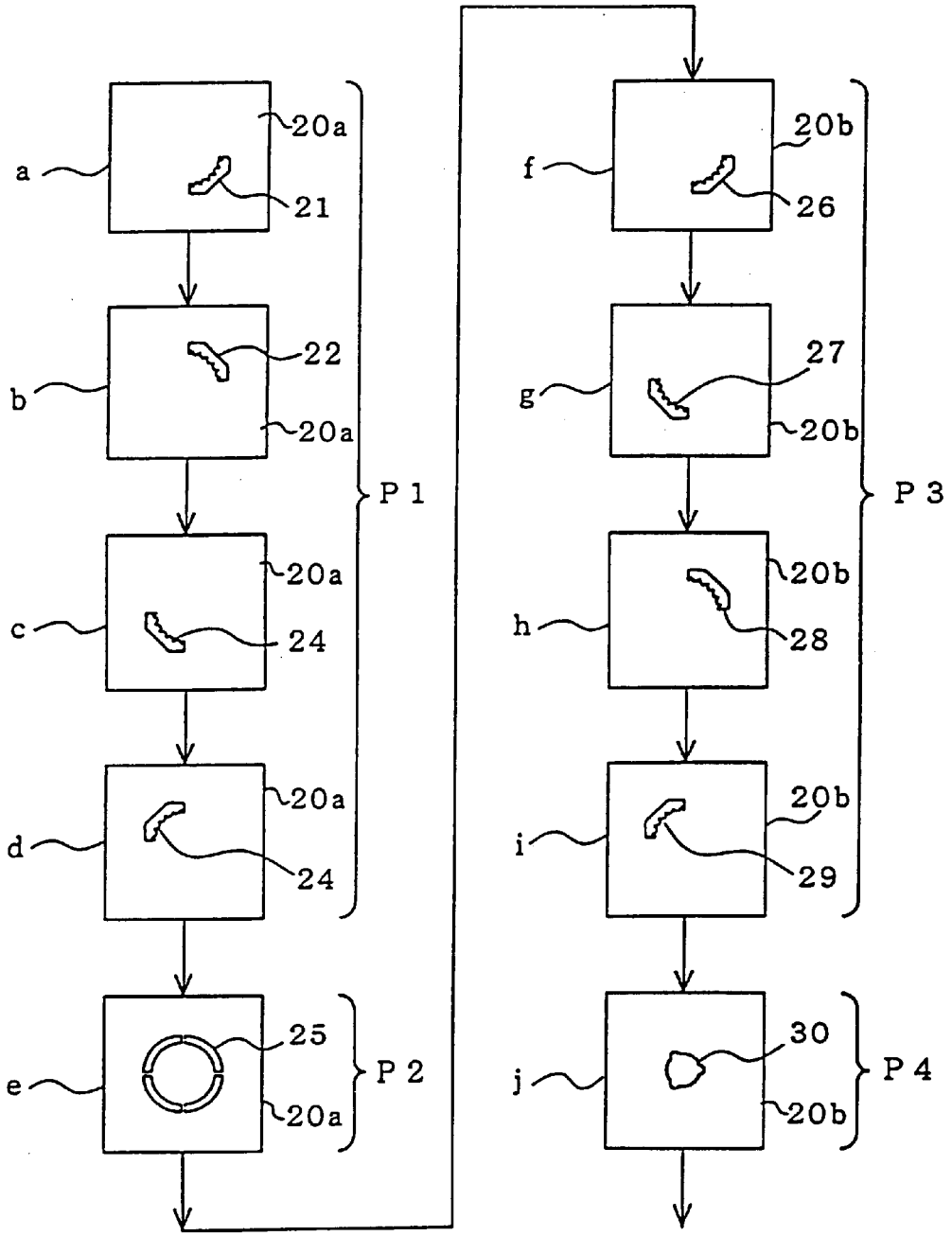
FIG. 6 is a plan view illustrating plane shapes of respective punching portions of a press die corresponding to progressive press-forming step in the embodiment 1.

In this embodiment, main portions of the star wheel 10 are worked by progressive press-work in the order of FIGS. 2(*a*) to 2(*f*). In the press-work, the star wheel 10 is worked with a press die shown in FIG. 6. FIG. 6 is a partial plan view of a press die, showing the structure of punching portions of the press die used in the manufacturing process where a formed area shown in FIG. 2 is formed in the width direction of a band-like metal plate. In FIG. 6, a plurality of portions enclosed by rectangular frames illustrate partial plan views of the die. Although the press die has a cope and a drag (a punch and a die), both the cope and drag are shown simply in the same plan view in FIG. 6. Here, the press die is constituted by punches 21 to 30 and dies 20*a* and 20*b*. Band-like stainless steel (SUS304) 0.12 mm thick was used as the metal plate in this embodiment.

Hereinafter the manufacturing method according to this embodiment will be described.

(a) First Forming Step P1:

First, a rough punching work is performed. In the rough punching work, while a metal plate is carried in a predetermined direction, hole portions A, B, C and D are formed successively in the metal plate by punching as shown in FIG. 2(*a*). It is an object of this rough punching work to form a rough outline shape of the outer circumference of the star wheel 10 so as to form a rough shape thereof. In this first forming step P1, a band-like metal plate is used, and a press die shown in FIG. 6 is used. Symbols a, b, c and d affixed to the left of the plan views of the press die indicate corresponding die portions for punching the above-mentioned hole portions A, B, C and D. By forming the four hole portions A to D successively in such a manner, not only the punches 21 to 24 can be made small in size, but also the punches 21 to 24 can be formed easily. Therefore, not only the press die can be designed so as to be light in weight, but also the labor or cost for forming the die can be reduced. Four connection portions X for connecting the portion which will be a star wheel to the metal plate body are formed between the above-mentioned holes A, B. C and D. The outline shape of the portion, which will be a star wheel, formed by this first forming step P1 is shown by the dotted line 11*c* in FIG. 4 which shows the outer edge portion of this portion in enlargement. The curvature radius of a portion corresponding to the tip of the tooth portion in this outline shape is larger than that in the outline shape formed in the third forming step which will be described later. Accordingly, the punching work can be made more easily in this step than in the third forming step, and a load imposed on the press die is lighter.

Figure 3:
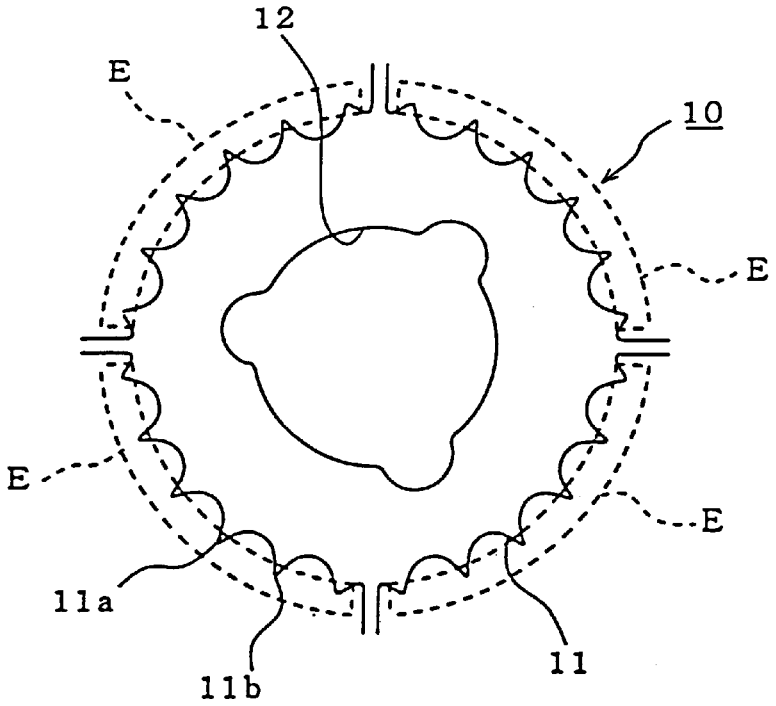
FIG. 3 is a partial plan view in the state where a star wheel is formed for showing an outline shape formed in the forming steps in the embodiment 1.
Figure 4:
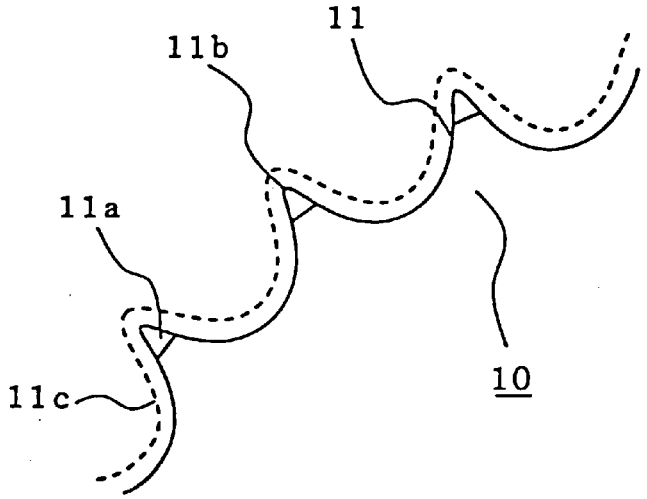
FIG. 4 is an enlarged plan view illustrating a plane shape of an outer circumferential edge portion formed in the forming steps in the embodiment 1.

(b) First Forming Step P2:

Next, a pressing work is given to the outer circumferential edge portion of the star wheel formed by the hole portions A, B, C and D, at quadrisectioned circular areas E (hereinafter referred to as face-pressing areas), as shown by the dotted line in FIG. 2(*b*). This step in which the face-pressing work is performed is to press the face-pressing areas E shown by the dotted line in FIG. 3 so that thin portions 11*a* thinned thereby are formed at the tips of the tooth portions 11 as shown in FIG. 4. In this second forming step P2, the outer circumferential edge portion is pressed at the same time by four arc (plane shape) punches 25 shown in e of FIG. 6. At this time, the face-pressing work is performed only on the portions except the connection portions X, so that no pressure is applied on the connection portions X. This is because in this manner the portion which is surrounded by the above-mentioned hole portions A, B, C and D and which will be a star wheel is prevented from being out of position or displaced so as to ensure the working precision in the following press works.

Figure 5A:
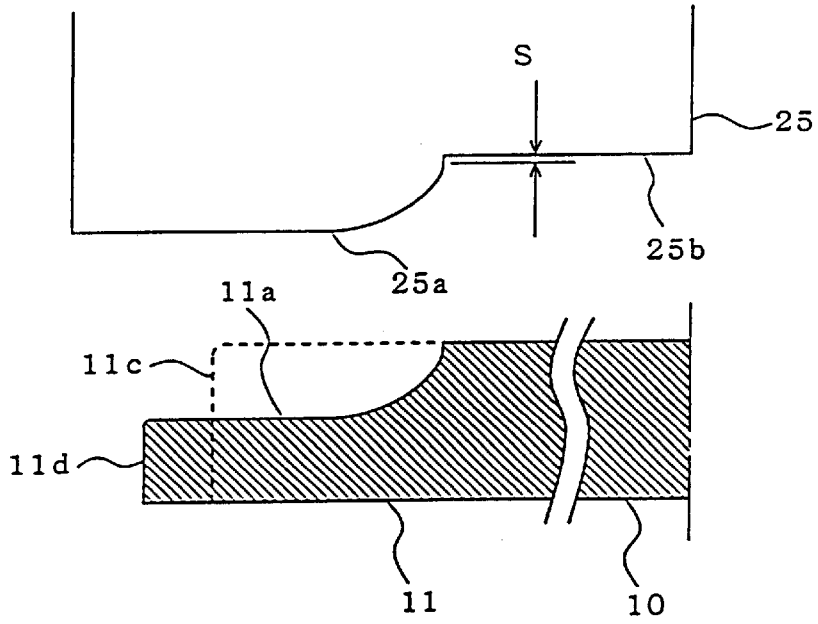
FIGS. 5(*a*) and 5(*b*) are enlarged sectional view illustrating a sectional shape of the circumferential edge portion formed in the forming step in the embodiment 1, together with a sectional shape of a punch.
Figure 5B:
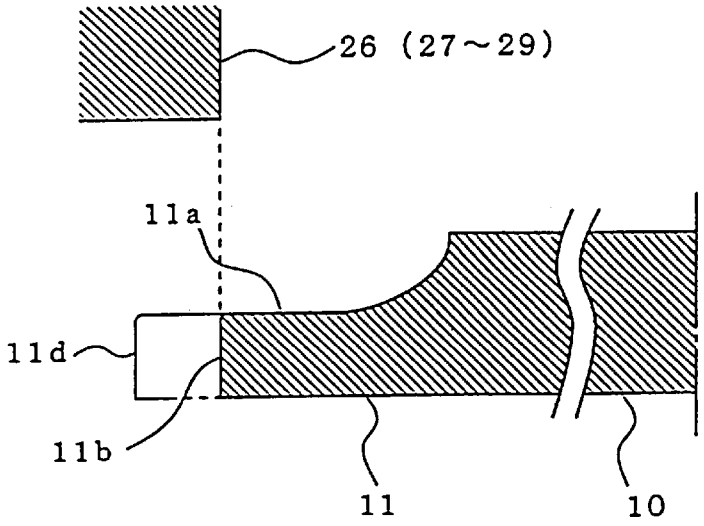

By the face-pressing work in this second forming step P2, each tip portion of the tooth portions 11 having an outline shape formed in the first forming step P1 is formed as shown in FIG. 5(*a*). In FIG. 5(*a*), each sectional shape of the tooth portions 11 after the completion of the first forming step P1 is shown by the dotted line 11*c*, and each sectional shape of the tooth portions 11 immediately after the second forming step P2 is shown by the solid line 11*d*. In the punch 25, a face-pressing portion 25*a* projecting along a gentle curve starting on the inner side is formed in an outer circumferential portion of the punch formed correspondingly to the tip portion of the tooth portion 11. Inside the face-pressing portion 25*a*, a flat surface portion 25*b* having a depth of recess is so formed that the surface portion 25*b* faces the metal plate with a slight clearance S (for example, about 0.01 mm) when the punch 25 comes to the lowest point. In the second forming step P2, the tip side of the tooth portion 11 is thinned to 0.06 mm which is about half the thickness of the metal plate which is 0.12 mm. The curved shape of the surface formed between the base portion and the thinned tip portion of the tooth portion 11 is formed into an arc with a curvature radius of 0.1 mm.

(c) Third Forming Step P3:

Next, as shown in FIG. 2(*c*), a punching work is further given to the hole portions A, B, C and D which had been subjected to the above-mentioned face-pressing work, so that hole portions F, G, H and I are formed successively. Also in this third forming step performing the punching work for the hole portions F, G, H and I, press-working is performed successively in the same manner as in the above-mentioned first forming step P1. In the press die, die parts f, g and i for forming the above-mentioned hole portions F, G, H and I are arrayed sequentially as shown in FIG. 6. This third forming step P3 is to precisely form the shapes of tooth portions 11 formed in the outer circumferential edge portion of the star wheel 10. The plane shapes and sectional shapes of the tooth portions 11 after the third forming step P3 are shown by the solid lines in FIGS. 3, 4 and 5(*b*).

This third forming step P3 is performed in the state where the tip portions of the tooth portions 11 have been pressed in the second forming step P2 after the rough outline shape of the outer circumferential edge portion of the star wheel has been formed in the first forming step P1. The tip portions 11*b* of the tooth portions 11 in the star wheel 10 completed finally have an extremely fine and detailed plane shape having a curvature radius of 0.04 mm as a set value or a curvature radius of 0.05 or less as an allowable range. The press die used in the third forming step P3 is manufactured with precision correspondingly to this, as will be described later. As shown in FIG. 5(*b*), each tip portion of the tooth portions 11 is thinned to about half the thickness by the face-pressing work in the second forming step P2 in this embodiment. Punching work is performed by the punch 26 (27 to 29) in this state, so that sharpness in the thickness direction as well as sharpness in the plane shape can be obtained. It is therefore possible to obtain enough sharpness of the tip portion 11*b*. At the same time, the plane shape of the tip portion 11*b* of the tooth portion 11 can be worked easily in the third forming step P3 on the grounds described hereafter.

Generally in press-working, working gets difficult drastically when the thickness of the metal plate rather than the width of the plane shape increases, and the durability of a press die is also decreased. In this embodiment, the rough shape (which is set into a shape for which press work can be performed rather easily) of the outer circumferential edge portion of the star wheel is formed in the first forming step P1, and the face-pressing work is thereafter performed on the tip portions of the tooth portions in the second forming step. The thickness is therefore relieved easily to the outside in the second forming step so as to perform the face-pressing work easily. Further, a finally finishing work in the outer circumferential edge portion of the star wheel is performed after the tip portions of the tooth portions are thinned by the face-pressing work. Therefore, the plane shape of the tip portion of each tooth portion can be shaped by cutting off after the thickness of the metal plate has been thinned over a width to be cut off to some extent. It is therefore possible to perform the finishing work more easily, and reduce the load on the press die so as to prolong the life of the press die as a result.

The punches 21 to 24 for punching out the hole portions A, B, C and D shown in FIG. 2, the punches 26 to 29 for punching out the hole portions F, G, H and I, and the dies 20*a* and 20*b* are formed by grinding work. Particularly the die 20*b* for punching out the hole portions F, G, H and I is of a split type so that the die 20*b* can be formed by grinding work. The working precision in the grinding work is about ±1 $\mu$m. On the other hand, the die 20*a* for punching out the hole portions A, B, C and D is integrally formed with precision of ±3 $\mu$m by wire electric-discharge machining in order to reduce the manufacturing cost of the die.

Figure 7:
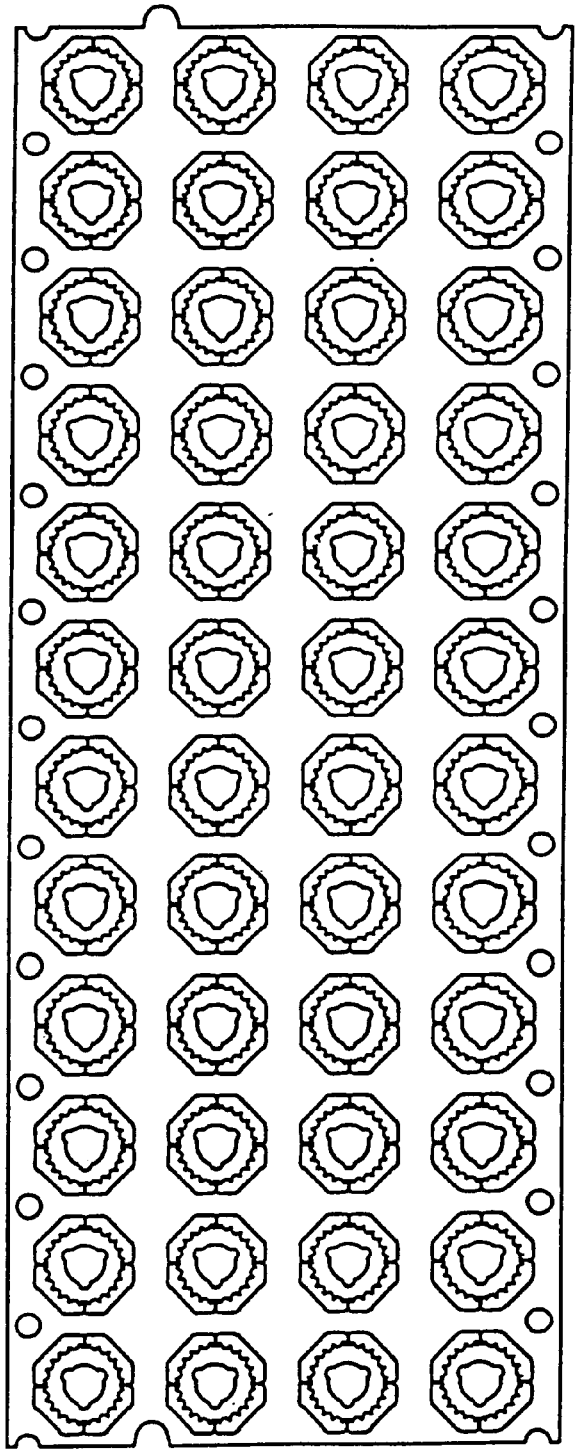
FIG. 7 is a plan view of a metal sheet in the step of FIG. 2(*d*)

(d) Fourth Forming Step P4:

In the process for manufacturing the star wheel 10, after the third forming step has been finished as mentioned above, a hole portion J which will be a central hole 12 is formed in a center portion of the portion which will be a star wheel 10, as shown in FIG. 2(*d*). The punch 30 of the press die in this fourth forming step P4 has a shape as shown in FIG. 6. The progressive press-work is completed in this fourth forming step P4, and the metal plate is cut into an appropriate size. In a product formed in a sheet in such a manner, portions formed as mentioned above which ought to be star wheels are arranged lengthwise and widthwise while the formed portions are held by the connection portions X, as shown in FIG. 7.

(e) Insert Molding Step Q:

Next, as shown in FIG. 2(*e*), a synthetic resin bearing portion K is integrally incorporated with the hole portion J of each formed portion by a conventional injection molding machine not shown. This work is an insert molding step Q.

(f) Removing-work Step P5:

Finally, a punching work is performed on the formed product again (removing-work step P5), so that the connection portions X are cut or removed and the star wheels 10 are completed.

The star wheels 10 manufactured by such a process were examined and compared with conventional ones manufactured by a manufacturing process including an etching step. The star wheels were really attached to an ink-jet recording apparatus and used therein. Then, a transfer condition of ink of a printed portion on a sheet surface and a damaged degree of a paper discharge roller constituted by rubber rollers disposed in opposition to the star wheels 10 are confirmed, in a plurality of printing modes (for example, in the state that the area rate of the printed portion or the printing resolution was changed at the time of printing) with plural kinds of sheet materials such as OHP sheets, glossy film, glossy paper, etc.. As a result, transfer characteristics which were by no means inferior to those in the conventional products could be obtained in each evaluation item. As to the damaged degree of the paper discharge roller, it was substantially the same as that in the conventional products after 20,000 A4-size sheets were discharged. With respect to these characteristics, it was confirmed that there was no problem in star wheels manufactured with a metal plate 0.2 mm thick, which was thicker than that in the above-mentioned embodiment. In addition, when the star wheels were manufactured according to this embodiment, including the step of incorporating the bearing portion K, the manufacturing cost was reduced by 42.8% in comparison with the conventional one.

Although progressive press-working of star wheels was described by way of example in the above-mentioned embodiment, the present invention is not limited to the embodiment. For example, the star wheels may be replaced by ordinary gears used for transmission of rotations. In this case, the present invention is extremely effective because it is demanded to form the shapes of the gears as precisely as or more precisely than the star wheels. In addition, the portion which is a target to be formed in the present invention is not limited to an outer circumferential edge portion as in the above-mentioned embodiment. The target portion may be an inner circumferential portion such as an internally-toothed gear. Further, it is not necessary to form all the outline shape in the steps of the present invention, and it will go well if at least a part of the outline shape is formed therein.

Embodiment 2.

Figure 8:
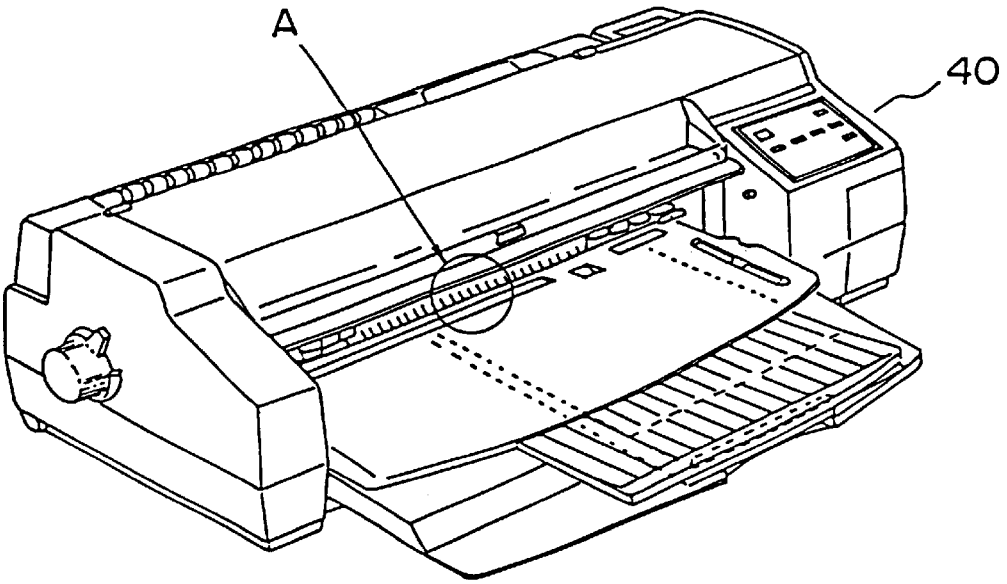
FIG. 8 is a perspective view of an ink-jet recording apparatus including a sheet feed mechanism in which star wheels manufactured according to the embodiment 1 have been incorporated.
Figure 9:
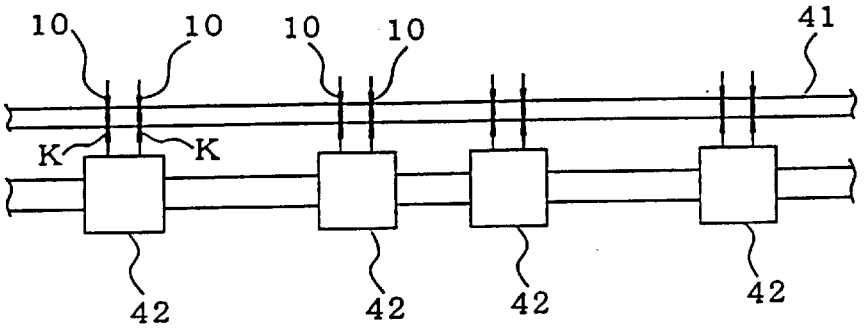
FIG. 9 is an explanatory diagram of the sheet feed mechanism in which a portion A in FIG. 8 is enlarged.

A sheet feed mechanism in which star wheels manufactured according to the above-mentioned embodiment have been incorporated is mounted on an ink-jet recording apparatus 40 shown in FIG. 8. The sheet feed mechanism is arranged in such a manner that a plurality of star wheels 10 are rotatably attached to a shaft 41 disposed perpendicularly to the sheet feeding direction, and the star wheels 10 are disposed in opposition to a paper discharge roller 42, as shown in FIG. 9. A sheet fed from driver rolls (not shown) is discharged after passing between the star wheels 10 and the paper discharge roller 42. At that time, tip portions 11*a* of the star wheels 10 have a shape sharp enough to catch the sheet properly, and prevent the sheet from slipping off to the side. Having been manufactured precisely as mentioned above, the tip portions 11*a* are not too sharp or does not have any burr, thereby avoiding damaging the paper discharge roller 42, or making a mark on the sheet.

What is claimed is:

1. A method of manufacturing a sheet pressing wheel for controlling a sheet feed direction in a sheet feed mechanism by plastic working of a metal plate comprising:

a first forming step of performing a punching operation for roughly forming at least a part of an outline shape of said wheel from said metal plate;

a second forming step of effecting a face-pressing operation on an outline edge portion of said wheel formed by said first forming step to thereby thin said outline edge portion; and a third forming step of shaping the now thinned roughly formed outline edge portion by a punching operation;

wherein said wheel has a protrusive portion in said outline edge portion; said first forming step and said third forming step forming a plane surface shape of said protrusive portion out of said metal plate; and said second forming step forming a sectional shape of said protrusive portion out of said metal plate so that said wheel is formed with a shape having an array of teeth as said protrusive portion.

2. A method for manufacturing a sheet pressing wheel according to claim 1, wherein in each of said first and third forming steps, said punching operation for forming the outline shape of said sheet pressing wheel is achieved by punching adjacent holes in said metal plate separated by unpunched connection portions.

3. A method for manufacturing a sheet pressing wheel according to claim 1, wherein in said first forming step, punching is so performed that the outline shape of said sheet pressing wheel has a curvature radius larger than that of the outline shape from said third forming step.

4. A method for manufacturing a sheet pressing wheel according to claim 2, further comprising the steps of punching a hole in a center portion of the sheet pressing wheel and integrally providing a bearing portion at said hole.

5. A method for manufacturing a sheet pressing wheel according to claim 4, comprising removing said connection portions after said bearing portion is integrally provided.

6. A method for manufacturing a sheet pressing wheel according to claim 1, in which said sheet pressing wheel is adapted for being included in a sheet feed mechanism of an ink jet recording apparatus.

* * * * *